United States Patent [19]

Campbell

[11] Patent Number: 4,928,823

[45] Date of Patent: May 29, 1990

[54] HOLDER FOR STAPLES, CARPET TACKS, NAILS, SCREWS AND OTHER DISCRETE MAGNETIZABLE ITEMS

[76] Inventor: James P. Campbell, 144 Laurel St., Bridgewater, Mass. 02324

[21] Appl. No.: 250,535

[22] Filed: Sep. 29, 1988

[51] Int. Cl.[5] ..... B65D 85/24

[52] U.S. Cl. ..... 206/338; 206/340; 206/372; 206/818; 224/252

[58] Field of Search ..... 206/38, 234, 338, 340, 206/341, 372, 373, 818; 220/334; 224/252

[56] References Cited

U.S. PATENT DOCUMENTS

| | | | |
|---|---|---|---|
| 115,175 | 5/1871 | Davis | 206/340 |
| 361,248 | 4/1887 | Winton | 206/818 |
| 1,549,400 | 8/1925 | Wimler . | |
| 2,452,400 | 10/1948 | Stevens | 132/9 |
| 2,455,506 | 12/1948 | Leslie | 206/818 |
| 2,457,421 | 12/1948 | Warren | 206/818 |
| 2,903,127 | 9/1959 | Dorman | 206/338 |
| 2,999,621 | 9/1961 | Kiser | 224/5 |
| 3,298,579 | 1/1967 | Smith | 224/5 |
| 3,680,750 | 8/1972 | Franco | 224/5 |
| 4,058,209 | 11/1977 | Schmidt | 206/350 |
| 4,151,912 | 5/1979 | Harrold | 206/338 |
| 4,303,158 | 12/1981 | Perkins | 206/373 |
| 4,303,188 | 12/1981 | Calabrese | 206/372 |
| 4,325,504 | 12/1980 | Amani | 224/183 |
| 4,471,881 | 9/1984 | Foster | 220/334 |
| 4,678,080 | 7/1987 | Nelson | 206/1.5 |
| 4,759,441 | 7/1988 | Leurck | 206/373 |

*Primary Examiner*—David T. Fidei

*Attorney, Agent, or Firm*—Herbert L. Gatewood

[57] ABSTRACT

A holder for a box of staples or loose carpet tacks, nails, screws and the like discrete magnetizable items is provided. A magnet is located on the underneath side of the top closure member for the holder to which a plurality of loose carpet tacks may become attached and which are separated from a supply thereof when the holder is shaken, making for easy, safe and injury free retrieval of carpet tracks from the holder by a carpet installer. The tacks can then, if desired, be temporarily attached to a magnet provided on the outside of the front wall of the holder providing ready access by the carpet installer to the tacks as and when needed during installation of carpeting. A box of staples can be carried instead in the holder, if desired, whereby the lines of staples can be kept intact and in unbroken condition prior to being loaded into a staple gun. One or more intact lines of staples can be temporarily attached to the magnet on the outside of the front wall of the holder, making such readily accessible by the carpet installer for loading into a staple gun.

5 Claims, 2 Drawing Sheets

HOLDER FOR STAPLES, CARPET TACKS, NAILS, SCREWS AND OTHER DISCRETE MAGNETIZABLE ITEMS

BACKGROUND OF THE INVENTION (1) Field of the Invention

This invention relates, in general, to a holder for a box of staples, or for a supply of loose carpet tacks, nails, screws, or the like fasteners and for other relatively small, discrete, magnetizable items used somewhat continuously in the performance of some activity. More specifically, this invention relates to the construction of such a holder, and its manner of use by a carpet installer or other person in the construction trade.

(2) Description of the Prior Art

When carpeting is being installed over wooden flooring, it is conventional to staple the edges of the carpet pad to the floor. This is accomplished by using an automatic staple gun which has been loaded previously with a line of staples. Staples, as is conventional, are provided in cardboard boxes and are arranged in such boxes in multiple rows of lines of staples superposed one above the other.

It is usual for a carpet installer to carry one or more boxes of staples in his tool box, along with other tools, e.g., in addition to the automatic staple gun, hammers, pliers, carpet knives, etc. In transporting the tool box around from place-to-place, the cardboard boxes containing the staples are jostled around in the tool box by the tools and become damaged, i.e., the cardboard boxes are torn. With further and continued jostling, the boxes may finally tear apart. As a result, the lines of staples are no longer confined by the box in which they are supplied and become scattered all over the tool box. Quite disadvantageously, when this happens, the staple lines are easily broken into loose staples or partial lines of varying lengths. And, the loose staples or partial lines are scattered throughout the tool box. As a result, there is much wastage of staples due to the fact that a carpet installer does not want to load the staple gun with partial lines of staples of varying length. To load a staple gun with a single partial line of staples means having to load the staple gun more often. On the other hand, to try to load a staple gun with what amounts to a full line of staples by assembling different lengths of broken lines of staples is time consuming and aggravating. These partial lines are scattered over the inside of the tool box and must be searched out by the carpet installer, by moving tools aside, or removing such entirely from the tool box in an effort to retrieve and use the partial lines of staples. Seldom can partial lines of staples be found that when loaded provide the length equivalent to an unbroken line, as supplied. Thus, the staple gun must either be loaded with partial lines that are less than the length equivalent to an unbroken line, or certain partial lines must be purposely broken and used, in part, to provide such a length. The loose staples, or very short partial lines, are not used at all. Thus, the carpet installer's job is made somewhat more time consuming as a result of having, in some cases, to load the staple gun with one or more partial lines which may or may not be equivalent in length to an unbroken line of staples, as initially supplied. Further, the overall cost of the installation is somewhat greater because of the greater time spent by the installer, the less efficient use made of his time, and the wastage of staples.

Carpet installers and other persons in the construction trade also have need for other fasteners than staples at times, e.g., carpet tacks, nails, screws and the like. These are supplied, in general, in loose fashion in a container, e.g., a plastic or cardboard box. The carpet tacks in the supply container are oriented in random fashion, the sharp points sometimes being upwardly disposed and providing potential for injury. When the carpet installer reaches into the box for a tack or two and encounters the sharp point of a tack, this may penetrate underneath his fingernail or otherwise puncture his finger. Thus, the result may be need for at least a band-aid or some manner of bandage to stop bleeding. And, in some cases, such injury may necessitate, or at least make desirable, a tetanus shot as a preventive measure against such disease. Such a puncture wound, moreover, always has the potential for infection and should not be treated lightly.

Furthermore, in some cases, and with some containers, as the supply of carpet tacks is used up during installation of a carpet, retrieving the carpet tacks from the container becomes somewhat more difficult. This results from the fact that the remaining supply of carpet tacks in the container is always located nearer the bottom of the box, and more out of reach of one's fingers as the supply of tacks are used up during installation. In some cases, the tradesperson may just simply pour a supply of tacks out from the container onto the floor or other work area so that such will be readily accessible, as needed. This, however, is an undesirable practice as any such tacks poured out and not used must then be picked up and put back into the container. Moreover, at times, stray tacks are overlooked and do not get picked up, resulting in the potential for injury in the event someone later steps on the tack.

Heretofore others have disclosed the concept of using permanent magnets as temporary holders, and in combination with various supporting means, for a variety of items and purposes. Exemplary of this prior art are U.S. Pat. Nos. 2,452,400; 2,999,621; 3,298,579; 4,058,209; and 4,325,504. In general, such inventions provide a person with ready access to one or more small items, or a continuing supply thereof, that are to be used from time-to-time in the performance of some activity by that person.

U.S. Pat. No. 2,452,400 is directed to a holder for hair pins which comprises a cup-shaped receptacle and a member for supporting the same on the shoulder of a patron in a beauty parlor. A tubular-shaped magnet is disposed along the inside wall of the receptacle, to which hair pins attach themselves and, because such are magnetizable, to each other. Thus, the supply of hair pins can be provided close to an operator's hand and can be removed individually by the operator from the receptacle, as desired. Such a holder, however, does not meet the requirements of Applicant's invention. The holder is not suitable at all for storage of a box of staples. And, without a top closure, neither is such a holder suitable for a supply of carpet tacks, or providing ready access thereto, as disclosed in this application.

In U.S. Pat. No. 2,999,621, there is disclosed a foldable tackle box which can be carried on a fisherman's belt. The box comprises a plurality of tackle holding trays hinged together so that the trays can be progressively unfolded to an open position or folded to a closed position. Hooks, lures and other articles which contain some iron material are held in orderly arrangement in the tackle box, until desired to be used, by magnets.

These magnets are provided in sheet form and are attached to the bottoms of rectilinear tray units which are hinged together to be foldable from a generally flat open position to a superposed face-to-face position in forming the box. A leaf tray which is hinged to one of the rectilinear tray units is folded into and contained within the box formed by the two rectilinear tray units. Thus, such a box could not be used at all to hold a box of staples as set forth by Applicant's invention disclosed herein. Neither could it be used to hold a supply of loose carpet tacks and to separate out from that supply a plurality of tacks for ready access, as contemplated by this invention.

U.S. Pat. No. 3,298,579 discloses a combined tee holder and ball marker which can be carried on a golfer's belt. The face of the supporting body of the tee holder and ball marker includes therein a magnet suitable for detachably holding a metallic, disk-shaped, golf ball marker. The supporting body is solid except for the cylindrical apertures provided at each end thereof for location of a golf tee. Thus, the body provides no means for holding a box of staples or a supply of loose carpet tacks.

U.S. Pat. No. 4,058,209 discloses a paper-clip dispenser which has an upwardly open receptacle with a hole in its bottom through which a stem carrying a magnet passes. When the receptacle is lifted off the top of a desk or other supporting surface the stem falls under its own weight or with the aid of a spring to bring the magnet at its upper end into a collection of paper clips at the bottom of the dispenser. When the dispenser is again placed upon the surface of a table or desk, the upper end of the stem is displaced upwardly to carry paper clips through the opening in the receptacle enabling them to be drawn off the magnet one at a time as required by the user. There is disclosed by the patentee a number of earlier, somewhat similar, prior art devices in which the paper clips are brought to the magnet by shaking the container or turning it over. Such a dispenser as contemplated by the patentee could not be used by a carpet installer to hold a box of staples for loading a staple gun. Neither is there a magnet located on the outside surface thereof for temporarily holding a line of staples or a plurality of loose carpet tacks. Moreover, neither does the prior art inventions disclosed by the patentee fulfill the requirements of the invention disclosed herein.

U.S. Pat. No. 4,325,504 discloses a magnetic device adapted to be worn on the arm or wrist of a carpenter for holding nails and the like. The device includes a contractible bracelet having a magnet supported externally on it. Thus, when a user such as a carpenter wears such a device on his wrist, the device can be used to hold a supply of nails and the like for immediate availability at the point of use. Nevertheless, the construction of the device is not box-like, and it could not hold a box of staples for loading a staple gun. Neither does the device provide means whereby a plurality of carpet tacks can be separated from a larger supply thereof, making such tacks readily available for use as and when needed.

Although all such magnetic devices as disclosed above are satisfactory for the purposes for which they are intended, none fully meet the requirements of this invention, as discussed above.

SUMMARY OF THE INVENTION

There is provided, in accordance with the general aspects of this invention, a holder for a box of staples, or for a supply of loose carpet tacks, nails, screws or the like small, discrete magnetizable fasteners.

A primary object of the invention is to provide a holder for a box of lines of staples whereby a ready and convenient supply of intact lines of staples as supplied by the manufacturer are readily available to a tradesperson for use in an automatic staple gun and whereby such supply box is protected from becoming damaged and torn.

A further object of the invention is to provide a holder for a box of staples whereby the individual staple lines will be protected from breakage and entire, intact staple lines are made readily available for loading and use in a staple gun.

A still further object of the invention is to reduce wastage of staples and to make carpet installation somewhat more efficient and more economical.

Another object of the invention is to make a carpet installer's loading of automatic staple guns somewhat less time consuming and frustrating.

Quite advantageously, a holder according to the invention is portable and can be easily carried around by a carpet installer or the like tradesperson.

Another advantage of a holder according to the invention is that such can be attached and detached to a metal tool box, as desired, and retained therein in a particular location until desired to be removed.

Another advantage of a holder according to the invention is that one or more lines of staples can be made even more readily accessible to the tradesman for loading a staple gun when being used, in that such staple lines can be temporarily attached, directly to the outside of the holder.

A further object of this invention is that a holder for a supply of loose carpet tacks, nails or other discrete, magnetizable items is provided wherein a ready supply of such carpet tacks, etc., is always conveniently and readily available for use by the carpet installer or other person in the construction trade, as and when needed.

Another advantage of the invention is that a ready supply of a plurality of carpet tacks, nails, etc. can be made always readily available at the top of the holder of the supply until the supply is completely depleted regardless of the decreasing supply thereof.

An advantage of the invention when used as a holder for loose carpet tacks is that a plurality of carpet tacks can be separated, as desired from time-to-time, from a larger supply thereof.

A further advantage of the invention is that a holder is provided wherein a carpet installer or other such trades person can withdraw a single carpet tack, if desired, from a supply thereof as needed.

A further advantage of the invention is that a continuing supply of carpet tacks, nails, etc., is made readily accessible to the carpet installer or the like while his hands are free in driving a carpet tack, etc. into a surface.

In a still further advantage, loose carpet tacks or the like can be carried in a holder according to the invention and retrieved therefrom by the carpet installer without being concerned that the sharp point of a carpet tack will puncture his finger or otherwise cause injury.

The objects and advantages as above set forth are attained in an invention which comprises in its basic aspects a body portion defined by planar, spaced-apart front and back walls parallel to one another, and planar, spaced-apart side walls which are parallel to one another and which are laterally disposed and in perpendicular relationship to said front and back walls at their edges whereby to form a box-like structure open at both ends thereof, a planar member disposed laterally and perpendicular to the planes defined by said front and back walls and said side walls and connected to said walls at their edges at one end whereby to provide a permanently closed end to the box-like structure, a closure member being provided at the end of the box-like structure opposite to said closed end providing access to the interior of the box-like structure comprising a planar member having an outer planar surface and an inner planar surface, said front wall being defined by planar inner and outer surfaces and a planar permanent magnet being secured to the outer surface of said front wall.

The invention in another embodiment comprises a holder such as above-disclosed wherein a permanent magnet of planar shape is also attached to the said inner planar surface of the said closure member.

In a preferred construction of a holder according to the invention, the holder can be used to hold an entire box of lines of staples, and is provided with belt loops so that it can be carried around on the belt of a carpet installer providing immediate and ready access by such a tradesman to a continuing supply of full, intact lines of staples as supplied by the manufacturer of the staples for loading into an automatic staple gun, as and when such is desired.

BRIEF DESCRIPTION OF THE DRAWINGS

The novel features and operation of a holder according to the present invention will be better understood by reference to the drawing, in conjunction with reading the following specifications, in which.

DETAILED DESCRIPTION OF THE INVENTION AND THE PREFERRED EMBODIMENTS

Figure 1:
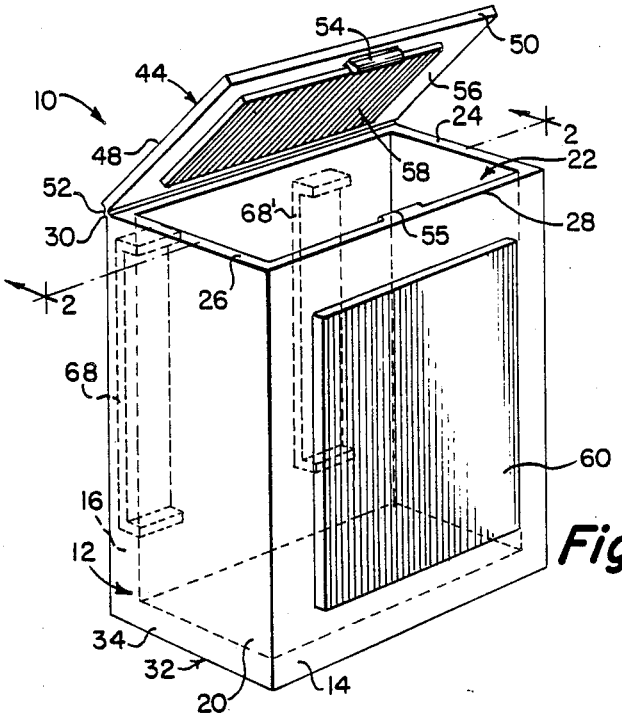
FIG. 1 is a view in perspective of one embodiment of a holder in accordance with the invention, in which the top, hinged closure member is in the partially raised or open position.

Turning now to the drawing, there is shown in FIG. 1 thereof, a holder 10 according to one aspect of the invention, useful for holding a ready supply of intact lines of staples, loose carpet tacks, nails, screws or the like magnetizable fasteners or other relatively small, discrete magnetizable items, to be used by a carpet installer or other person in the construction trade or otherwise. Holder 10 comprises a body portion 12 defined by planar, front and back walls 14, 16, parallel to one another, and spaced-apart, planar side walls 18, 20, parallel to one another and laterally disposed in perpendicular manner with respect to front and back walls 14, 16, whereby to form a box-like structure as shown in the drawings. Body portion 12, as will be readily appreciated by reference to FIG. 1, is further characterized by an open top end 22, defined by the top edges 24, 26 of the side walls and top edges 28, 30, of the front and back walls 14, 16, respectfully. The bottom end 32 of holder 10 is closed by planar closure member 34, which is fixedly secured to the bottom edges 36, 38, of the side walls and bottom edges 40, 42 of the front and back walls, respectively.

As will be appreciated from the drawings, the top edges of the front and back walls and of the side walls all terminate in the same plane which is laterally disposed in perpendicular fashion to the lengthwise directions of the walls. And, the said bottom edges all terminate in a plane parallel to the plane defining the top edges. Thus, there is disclosed in FIGS. 1–3, a rectangular-shaped box-like structure; however, it will be appreciated that, in some cases, the box-like structure can be of square configuration rather than rectangular if desired.

Figure 2:
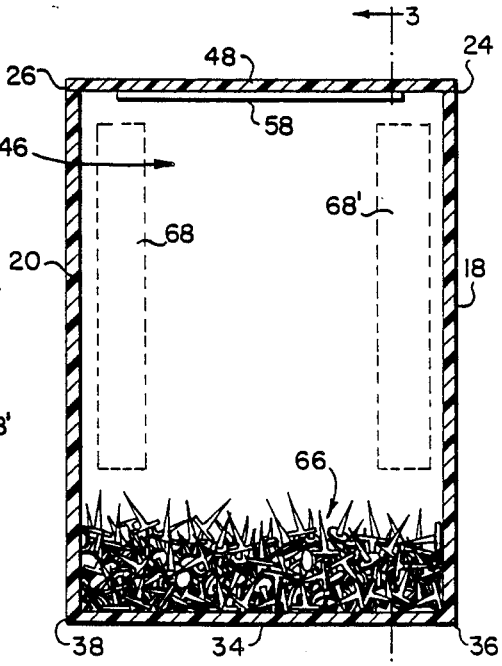
FIG. 2 is a front sectional view taken at secant lines 2—2 in FIG. 1 showing a dwindling supply of loose carpet tacks located nearer the bottom of the holder.
Figure 3:
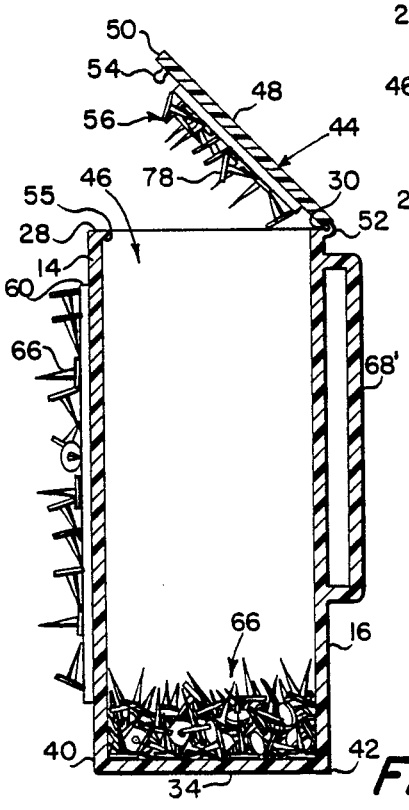
FIG. 3 is a cross-sectional view of the holder shown in FIG. 1 taken at secant lines 3—3 in FIG. 2, and showing a plurality of carpet tacks which have been separated from the supply or assemblage thereof shown in FIG. 2, these being shown attached to the permanent magnet which is located on and fastened to the inner or underneath side of the top closure member of the holder and other such previously separated carpet tacks which have been removed from the closure and are temporarily attached to the permanent magnet on the outer surface of the front wall of the holder.

Closure member 34 can be, if desired, provided integral with body portion 12, during the manufacture thereof, or manufactured separately and later be secured to the bottom edges of the front and back and side walls by suitable fastening means, e.g., adhesive, nails, screws, etc., depending somewhat upon the material of construction chosen and the overall size of the holder, the wall thickness, etc. Although the edges defining closure member 34 are shown in FIG. 2 and FIG. 3 to be coextensive with planes defining the outer surfaces of the front and back walls 14, 16, and side walls 18, 20, those skilled in the art will readily appreciate that such need not be the case. The closure member 34 can be of such a dimension that it will fit within the bottom end of body portion 12, the outer surface thereof being flush with the bottom edges of the walls.

At the open top end 22, there is provided a hinged closure member 44 providing for access to the box-like inside cavity 46 defined by the front and back, and side walls. The hinged closure member 44 comprises a planar base member 48 defined by front edge 50 and back edge 52. As will be seen by reference to FIG. 1, a flange member 54 depends perpendicularly downwardly from the underneath surface 56 of closure member 44, the purpose for which will soon be disclosed. Closure member 44 is hingedly connected (hinges not shown) at its back edge 52 to back wall 16 at its top edge so that closure member can be raised as shown in FIG. 1 providing access to the inside of the holder. This hinged connection can be provided in accordance with various conventional techniques, depending somewhat upon the material of construction for the holder. Hinges can be provided separate from manufacture of the body portion 12, as can closure member 44, and then be secured by suitable means, e.g., adhesive, to the outside surfaces of the back wall 16 and top closure member 44 adjacent to the top and rear edges thereof, respectively. Or, the hinges can be secured, if desired, to the underneath surface of the closure member and the inner surface of the back wall. Two hinges can be provided in spaced-apart location, or a single elongated hinge can be used. Where the material of construction of the holder is a plastic composition, the back edge 52 of the top closure member can even be provided integral with the back wall 16.

When closure member 44 is closed against the body portion 12, the outer, longitudinal surface of flange 54 will be in frictional contact with the inwardly projecting flange 55 provided at the top edge of the front wall 14. Thus, closure member 44 will stay in the closed position until some slight force is used to pry open the closure member. As a result, the holder will not be inadvertently opened on its own. Other conventional fastening means can be provided, if desired, to maintain closure member 44 in the closed position. Such fastening means is of no consequence to the invention. For example, the elongated flange 54 can be provided at the front edge 50 so that it will overlap the outer surface of the front wall 14 at the top and be provided with an inwardly projecting protrusion which mates with an indent provided in the outer surface of front wall 14. Flange member 54 can, if desired, extend substantially across the length of front edge 50; however, this need not be the case. It can be of somewhat shorter or longer length, as desired. Or, if desired, in some cases, the flange member can overlap the front wall and extend the full length of edge 50 and wrap around the side edges of closure member 44 terminating at the back edge 52. In such a case, the inside surface of the flange can be provided, if desired, with an elongated rib which extends substantially the full length of the flange and which mates with an elongated groove provided in the outside surfaces of front wall 16, and side walls 18, 20.

Although closure member 44 is preferably hingedly connected as disclosed hereinabove to body portion 12, it may be provided, in some cases, separate therefrom. Thus, closure member 44 can take the form of a separable closure member which comprises a planar member 48 such as shown in FIG. 1. In this case, if desired, a flange member can be provided extending downwardly and around the entire perimeter of the closure member which frictionally engages the outer wall surfaces at the top edge.

On the inner or underneath surface 56 of closure member 44 there is provided, in accordance with a unique feature of the invention, a permanent magnet 58 the purpose for which will soon be more fully disclosed. This magnet is of a planar, rectangular-shaped configuration, one surface of which, as shown, is permanently secured by suitable means e.g., adhesive, to the underneath surface 56 of closure member 44. The permanent magnet 58 can be any such conventional magnet provided it has sufficient magnetic force to accomplish the purposes of this invention. Magnet 58 need not be of metal and can be a suitable commercially available strip of magnetic composition, if desired, provided such has suitable permanent magnet characteristics. A similar permanent magnet 60 is fixedly secured to the outside surface of front wall 14, its function and purpose being described hereinafter.

Figure 4:
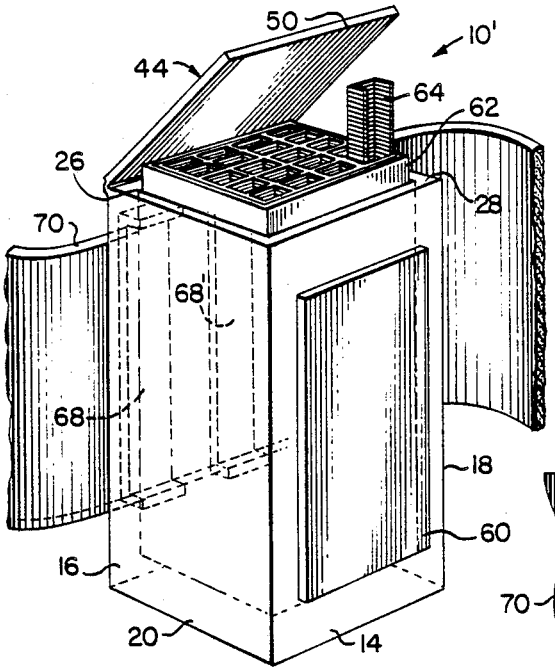
FIG. 4 is a view in perspective of another holder in accordance with the invention showing such holder being carried on the belt of a carpet installer (not shown) and showing a box of staples partially inserted therein, the top end of such box having been torn off leaving the ends of the intact lines of staples readily accessible for removal of a line of staples, as and when desired.

The holder of this invention need not be of the rectangular cross sectional shape disclosed in FIGS. 1–3. Referring to FIG. 4, there is shown therein another holder 10', in accordance with another embodiment of this invention. The holder 10' therein is of a square cross-section, otherwise it is of the same construction as holder 10' shown in FIGS. 1–3. It will be appreciated, however, that as holder 10' is particularly suitable for holding a box 62 of intact lines 64 of staples that a magnet 58 on the underneath side 56 of closure member 44 is not necessary, and can be omitted. Nevertheless, those skilled in the art will recognize that a universal holder can be provided, if desired, of suitable dimensions for holding either a box 62 of staples or a supply of loose carpet tacks 66.

Figure 6:
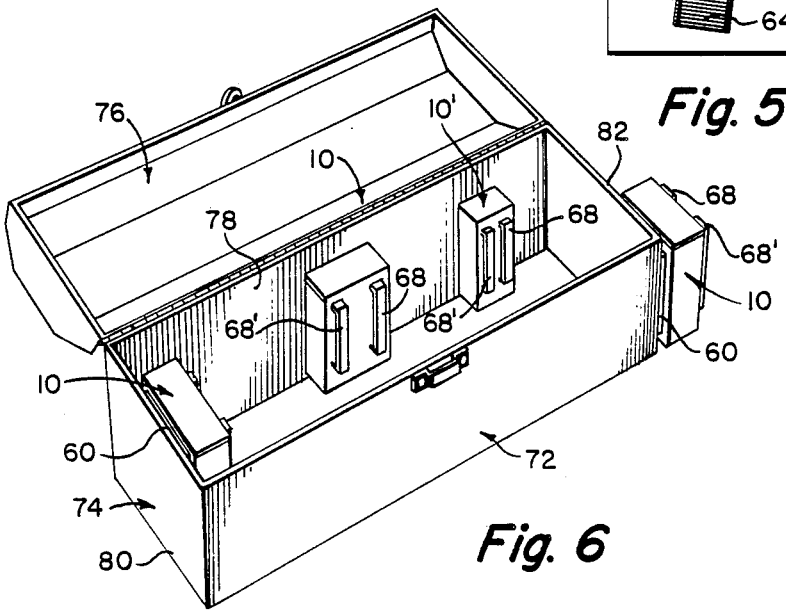
FIG. 6 is a perspective view of a metal tool box, showing the lid thereof in raised, open position and showing nothing contained therein for sake of clarity except a plurality of holders according to the invention which are each temporarily attached to the inside, vertical surfaces of the back wall and an end wall of the tool box by the permanent magnets located on the outside surface of the front wall of each of the holders, and a further holder attached in similar manner to the outer, vertical surface of the tool box at one end.

Referring now to FIGS. 3 and 6, it will be readily seen that, in the preferred embodiment of the invention, holder 10 (likewise holder 10') is provided on the outside surface of back wall 16 with spaced-apart belt loops 66, 68'. Thus, a carpet installer or other such trades person can carry the holder 10 on his person when installing carpeting, making it unnecessary to carry around a heavy tool box just to have a ready supply of staples or carpet tacks available for use, and in easy and ready access. A separate belt 70 might be provided for this purpose or the carpet installer's pant's belt could be used instead. The belt 70 could be used to carry both a holder 10 containing a supply of carpet tacks 66 and a holder 10' containing a box of intact staple lines, or either, as desired.

A holder according to the invention can be provided of various materials of construction, for example, various plastic compositions, wood, metal, or even leather. The most preferred material of construction for such a holder is a plastic composition, as such provides for ease and economies in manufacture. The holder 10 can be provided as an integral unit by various conventional plastic molding techniques, e.g., injection molding. Nevertheless, the various components thereof can, if desired, be separately manufactured and then assembled together into a holder as shown. In such a case, the edges of the sides can be secured to one another by suitable adhesives. Examples of various plastic compositions that can be used include polyvinyl chloride, polyethylene, and polypropylene. The compositions can be clear or provided of different colors, whereby to provide a color code for the user, depending upon the intended use for the holder, e.g., yellow for pad staples, red for electric staples, blue for concrete nails, orange for carpet tacks, etc. In addition to coloring agents, the plastic compositions used can include various conventional fillers, e.g., to provide the desired rigidity or stiffness, etc.

A holder of this invention can be provided of any size desired dependent somewhat upon the intended use therefor, and the convenience of the user. Where a holder is to be used for holding a box of staples for use with an automatic staple gun, it will necessarily need be of such internal dimension to accommodate the dimensions of the staple box. Where the holder is to be used for loose carpet tacks or the like it can be provided of a size sufficient to carry any amount of such carpet tacks desired.

Although the holders 10 and 10' disclosed in the drawings show the top closure member 44 located at an elongated end of the box-like structure, it will be appreciated that such need not be the case. These ends can, if desired, both be closed and the top closure member be located, instead, at the location of a side, or even the front, wall. In this case, the belt loops 66, 68' will be oriented 90° with respect to those shown in the drawings. Thus, considering FIG. 1, if side wall 20 becomes the top closure member, magnet 58 will be provided on its inner surface, rather than on inner surface 56. And, side wall 20 will then be adapted for opening and closing with closure 44 being fixed the same as end closure 32.

The permanent magnets 58, 60 can be of rectangular or square shape as desired, depending somewhat upon the shape and size of the surfaces to which either is attached. The main requirements are that such magnets have sufficient magnetic attraction and strength to accomplish the purposes of this invention. In general, magnet 58 will need be of such strength to readily extract a plurality of carpet tacks 66 from the supply thereof. Nevertheless, it should not have an attraction that will hold more than a couple of layers of tacks; otherwise, due to the fact that the tacks are magnetizable, and such will cause attraction one tack for another, a string of tacks may be formed leading back to the supply, and providing difficulty in, or no separation therefrom. Those skilled in the art, however, can readily determine the optimum magnetic attraction desired.

In the case of magnet 60, such should hold, in general, a single layer of tacks 66, as shown in FIG. 3. The magnet 60 should have sufficient strength that carpet tacks 66 do not inadvertently detach therefrom. Nevertheless, the magnet 60 should not be so strong that a carpet installer experiences difficulty in removing a tack 66 from the magnet.

Where magnet 60 is to be used to hold an intact line 64 of staples such magnetic strength need be such as to firmly hold the line of staples yet permit ready removal therefrom by the carpet installer without breaking of the line of staples.

The magnets 58, 60 can, in general, be secured to their supporting surfaces without concern for the particular orientation of the poles thereof. The magnetic flux of the permanent magnets 58, 60 between the poles will be from one end thereof to the other and will attract and hold the iron or steel carpet tacks or lines of staples against their planar surfaces as shown in the drawing. If a conventional magnetic composition containing small particulate permanent magnets is used, instead of a conventional permanent magnet of metal, the orientation of such a strip of material is, in general, of no consequence. Nevertheless, it is believed that the optimum location of the magnets 58, 60 is within the skill of the art.

Turning now to FIG. 6, there is shown a tool box 72 comprising an open top body member 74 and a top cover 76 in the raised position. The tool box 72 is empty except for the two holders 10 and the holder 10' of the invention which are detachably connected by magnets 60 to the inside surfaces of the back wall 78 and end wall 80 of the tool box. Also shown is a holder 10 connected to the outside surface of end wall 82 of the tool box. Thus, the holders 10 and 10' will remain where attached to the tool box until detached and removed from the tool box, when and as desired by the carpet installer. As earlier disclosed, the holders 10 and 10' can be used to hold a box of staples, or loose carpet tacks, nails, etc., as desired.

Figure 5:
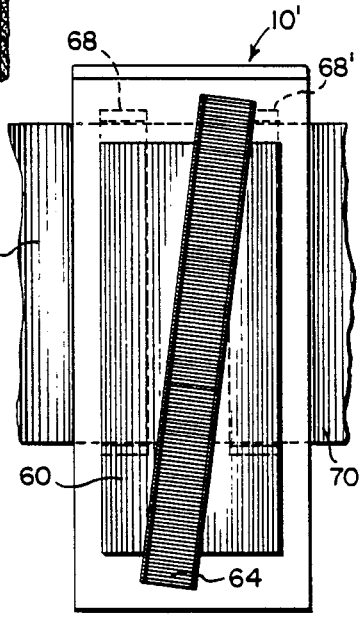
FIG. 5 is a front view of the holder of the invention shown in FIG. 4, showing an intact line of staples which has been removed from the box thereof and which has been attached to the permanent magnet located on the outside surface of the front wall.

When a carpet installer goes to the job-site, he can detach a holder 10' containing a box of staples 62 from the tool box 72. The box of staples can be partially removed from the holder, if desired, as is shown in FIG. 4 and two or three intact lines 64 of staples taken therefrom. One of the staple lines removed from the holder 10, can be loaded into the staple gun (not shown). The other staple lines removed from the holder can then be temporarily attached to magnet 60, as is shown in FIG. 5. Thus, an intact line of staples will be readily accessible to the carpet installer, as needed, for loading into the staple gun. Other staple lines are removed from holder 10' and temporarily attached to magnet 60, as and when desired. It will be appreciated that more than one intact staple line can be held by magnet 60, depending on the size thereof. The holder can be carried on belt 70 (FIG. 5), if desired, by threading the belt in usual fashion through belt loops 66, 68' and the belt fastened around the waist of the carpet installer (not shown). Although holders 10, 10' are disclosed herein to be provided with two belt loops 66, 68' it will be appreciated that such need not be the case. One somewhat wider, belt loop can be provided, instead, if desired. The belt loops 66, 68' can, if the holder 10 is manufactured of a plastic composition, be provided integral with back wall 16. Or, the belt loops can be manufactured separately and secured thereto by suitable fastening means such as rivets or adhesive. Belt 70 can be provided specifically as a utility belt to carry one or more holders 10, 10' thereon, or, if desired, such belt can be the one worn by the carpet installer on his trousers. Although most preferred, holders 10, 10' need not even be provided with any belt loops. Where such is the case, the carpet installer can carry holders 10, 10' around by hand, if desired. A holder 10, 10' can also, if such is desired, be detachably located, as shown in FIG. 6 on the outside of the tool box, making for ready access there to and its contents. Such provides means for carrying holders to a job site even if the tool box is full and no space is available for the supply of carpet tacks or staples.

Referring now to FIGS. 2 and 3, there is shown therein a holder 10 in which is located a somewhat depleted supply of carpet tacks 66, located nearer to the bottom of holder 10. This ordinarily makes for some difficulty in retrieval of tacks for use, as the tacks are just out of range of the reach of one's fingers. And, as can be appreciated, the supply of tacks 66 makes for an unsafe condition as the points of some tacks are oriented vertically upwardly; however, both problems are readily overcome by the holder 10 of this invention. Thus, as carpet tacks 66 are needed, the carpet installer merely shakes the holder 10 in an up and down fashion. This causes some of the carpet tacks 66 which strike magnet 58 to be attracted thereto and to be detachably connected to the magnet, as shown in FIG. 3. Other carpet tacks not attracted at all, or without sufficient attraction by the magnet, fall to the bottom of the holder. The carpet installer can then remove the tacks 66 from magnet 58 and place them in contact with magnet 60, whereby a layer of a plurality of carpet tacks will be readily available for use, as needed. This allows the carpet installer to select one tack at a time, as desired. A further ready supply can then made available by again shaking the holder 10 causing other carpet tacks to be attracted by, and attached to, magnet 58 or to one another. This process of separation and supply of carpet tacks can then be repeated as desired.

Although, as disclosed herein, a magnet is most desirably provided on the outside surface of the front wall of the holder, it will be appreciated that, in some cases such magnet can be provided, instead, on the outside surface of one or the other side walls. If desired, a permanent magnet can be provided on both the front and a side wall, or even on both side walls. The main thing is that the magnets provided be permanent magnets of a planar configuration and that such a magnet be provided on at least one of the outside surfaces for the holding of a line of staples or a layer of carpet tacks.

Other modifications and changes, as will be readily understood by those skilled in the art, can be made in the invention and its form and construction without departing from the spirit and scope thereof. The embodiments disclosed herein are merely exemplary of the various modifications that the invention can take and the preferred practice thereof. It is not, however, desired to confine the invention to the exact construction and configurations shown and described herein, but it is desired to include all such as properly come within the spirit and scope of the invention disclosed.

What I claim is:

1. Holder for a plurality of lines of staples, carpet tacks, nails, screws and the like magnetizable discrete items defined by planar, spaced-apart, front and back walls parallel to one another, and planar, spaced-apart, side walls parallel to one another and laterally disposed perpendicularly to said front and back walls whereby to form a box-like structure open at both ends thereof and having an inner and outer planar surface, a planar member at one end for closing the said box-like structure at the said one end, and a closure member at the other end for closing the said box-like structure at the said other end and for providing access to the interior of the box-like structure, said closure member being defined by a front edge and a back edge and said closure member being hingedly attached to said back wall of the holder at said back edge, said closure member being further defined by an outer and an inner planar surface, and a magnet of planar configuration being attached to said inner surface, said magnet providing means for separating a number of discrete items from a larger number thereof and detachably retaining such for ready access at the top end of the holder, and a magnet fixedly secured to the outer surface of said holder for providing means suitable for detachably holding one or more intact lines of staples or a plurality of said discrete items.

2. Holder according to claim 1 wherein means are provided on said closure member for detachably connecting said member to the said open top holder.

3. Holder according to claim 2 where said means is a flange member that depends perpendicularly downwardly from said inner surface adjacent the said front edge of the closure member whereby on closing of the said closure member the said flange frictionally engages with a member provided on said front wall.

4. Holder for a plurality of loose carpet tacks, nails, screws and the like discrete items capable of being attracted to a magnet, said holder being of a box-like structure and being defined by planar, spaced-apart, parallel front and back walls, and parallel, spaced-apart side walls, said box-like structure being further defined by a closed bottom and an open top whereby to define an internal, elongated cavity for the holding of said plurality of loose, discrete items for use, a closure member for said open top defined by an inner planar surface, and a planar magnet being attached to said planar inner surface of the said closure, whereby as the discrete items in the holder are used and the number of loose discrete items remaining in the holder diminishes so that any of such items remaining becomes less accessible, certain of the remaining such items can be made readily available to the user at the top of the holder and easily accessible for use by the user shaking the holder and causing the diminished supply of discrete items to contact the said magnet whereby certain of said discrete items will be attracted and separated from the others in the diminished supply and detachably held by the magnet.

5. Holder according to claim 4 wherein said front wall is defined by an inside and outside planar surface, and a planar magnet is attached to the outside surface of said front wall whereby a plurality of said discrete items can be detachably held for use as needed.

* * * * *